US006041547A

United States Patent [19]

Marocco

[11] Patent Number: 6,041,547

[45] Date of Patent: Mar. 28, 2000

[54] SHUTTER WITH SIDE PULL CONTROL BAR

[75] Inventor: Norbert Marocco, Woodbridge, Canada

[73] Assignee: Shade-O-Matic Limited, Toronto, Canada

[21] Appl. No.: 09/228,294

[22] Filed: Jan. 8, 1999

[51] Int. Cl.[7] ..... E06B 7/086

[52] U.S. Cl. ..... 49/87.1; 49/403

[58] Field of Search ..... 49/87.1, 74.1, 49/403

[56] References Cited

U.S. PATENT DOCUMENTS

| | | | |
|---|---|---|---|
| 2,209,384 | 7/1940 | Brown | 49/87.1 X |
| 4,268,995 | 5/1981 | Villa | 49/87.1 |
| 5,238,042 | 8/1993 | Guerrico-Echeverria | 49/87.1 X |
| 5,548,925 | 8/1996 | Marocco | 49/87.1 X |
| 5,778,598 | 7/1998 | Ohanesian | 49/87.1 X |

*Primary Examiner*—Jerry Redman

[57] ABSTRACT

A shutter having a generally rectangular frame with side frame members and top and bottom members, of hollow thermo-plastic construction, and having a plurality of hollow thermo-plastic blades extending horizontally from one side frame to the other, and having blade end members with pivot axles extending outwardly at each end received in bearing holes in the side frames, the holes being located at predetermined spacings along the shutter frames, so as to provide a pleasing appearance and to permit complete closure of the shutter when the blades are rotated closed, and the shutter blades being connected by means of a pull bar, the pull bar being connected to the shutter blades along one end of each of the blades, and connections pivotally connected with the end members of one end of each of the blades, and coupled to the pull bar.

12 Claims, 4 Drawing Sheets

SHUTTER WITH SIDE PULL CONTROL BAR

FIELD OF THE INVENTION

The invention relates to shutters such are used for closing windows and doors and other openings, and in particular having a plurality of shutter blades which are controlled by a pull bar located along one end of each of the blades.

BACKGROUND OF THE INVENTION

Traditional shutters are basically designed having a rectangular frame, and plurality of shutter blades pivotally mounted in a generally horizontal fashion extending across the frame, and being swingable between a closed and opened position.

Typically, such shutter blades are controlled and moved by means of a control pull bar. In the past, such control pull bars have usually been mounted centrally down the centre of the blades, and are simply linked to the blades by pivotal connections, so that all of the blades may be pivoted between open and closed positions by a single movement.

This basic design may have been in use for hundreds of years or more. However, there are certain disadvantages. In the first place, the location of the pull bar is somewhat unsightly, since when the shutter blades are swung open the pull bar is positioned in such a way that it extends down the centre of the opening.

In addition, such pull bars may have been suitable for construction where shutter blades were made of wood, but are not as suitable for use where shutter blades are made of thermo-plastic material.

The tendency, at the present time, is to manufacture such shutters with extruded thermo plastic side and end frames, and extruded thermo plastic blades. The extruded thermo plastic blades are hollow, and are cut to a predetermined length. Each end of the blade is provided with a plug end member which plugs into the end of the blade. The plug end members are formed with pivot axles which fit into holes in the side frames.

For this type of shutter, attaching a pull bar centrally of the shutter blades means that each individual shutter blade must have an opening cut in it, and some form of plug in fixture must be inserted into each blade.

Another factor in the manufacture of such shutters is that the opening which the shutters must fill, will vary from one house to another, and from one window or one door to another. In the past, shutters were made with blades having a pre-set fixed spacing between them. The shutter frames were made with relatively wide sections of material, usually wood, and in order to fit the shutter to a particular space, it was customary to cut portions away from either the top or the bottom or both of the shutter frames.

This might result in the installation of shutters which had an appearance which varied from one shutter to another, and in which the shutter blades themselves would not necessarily be aligned all the way across a window or door opening.

A few designs have been produced in which the shutter blades are provided with a pull bar at one end, but again, the location of the pull bar at the end has usually required the use of several components for connecting with each blade which results in an uneconomical construction, and in addition a design which may result in failure in one a the plurality of parts.

An additional factor in the design of such shutters is the tendency of the shutter blades to either swing shut or swing open, in an uncontrolled fashion, especially in drafts or in winds.

Preferably some form of friction or braking mechanism will be provided so as to control the movement of the shutter blades, so that once adjusted they will hold still in a predetermined desired location.

BRIEF SUMMARY OF THE INVENTION

With a view to providing a shutter construction which deals with most of the foregoing problems, the invention will be seen to comprise a shutter having a generally rectangular frame comprising side frame members and top and bottom members, of hollow thermoplastic construction, and having a plurality of hollow thermo-plastic blades extending horizontally from one side frame to the other, and having end members with pivot axles extending outwardly at each end and being received in pivot holes in the side frames, the pivot holes being located at predetermined spacings along the shutter frames, so as to provide a pleasing appearance and to permit complete closure of the shutter when the blades are rotated closed, and the shutter blades being connected by means of a pull bar, the pull bar being connected to the shutter blades along one end of each of the blades, and a connection mechanism pivotally connected with the end members of one end of each of the blades, and being operatively coupled to the pull bar, whereby operation of the pull bar upwardly or downwardly will move all of the shutter blades simultaneously by rotating the same between closed and opened positions.

The connection between the shutter blades and the pull bar is preferably effected by some form of connection means formed in the end members of the shutter blades themselves, which connections means can be coupled at spaced points along the pull bar, so that the pull bar extends between the connection means, thereby coupling all the blades for movement together in unison.

Preferably, the end members at one end of each of the shutter blades are formed with pivot receiving recesses, and openings are formed in such end members, to receive rotatable pivot couplings therein.

The invention further envisages that the pull bar will also be formed of hollow extruded construction of thermo-plastic material, and that there are pull bar connectors each formed with a plug member for snapping into a corresponding opening in the pull bar, so that each of the connectors is secured to the pull bar at a predetermined spaced apart location corresponding to the spacing between the blade receiving openings in the side frames.

In the preferred form, rotatable pivot couplings are connected to the end members of each of the shutter blades, and these rotatable couplings are in turn connected to respective pull bar connectors, secured to the pull bar at spaced intervals.

In one particular embodiment, a braking friction means is provided connected to one of the shutter blade pivots, and is located within a side frame, and provides a frictional binding on the shutter blade to which it is connected. Through the agency of the pull bar, the braking means controls the angular positions of all of the shutter blades in that shutter.

In another feature of the invention, the shutters are provided with blades in which the spacing of the blades can be varied from one shutter to another, during manufacture and in which the spacing of the attachment to the pull bars can also be varied to correspond to the varying in spacing between the shutter blades. In this way it is possible to provide shutters having a uniform appearance across a window or door opening, notwithstanding that the shutters themselves may necessarily have different overall dimensions.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
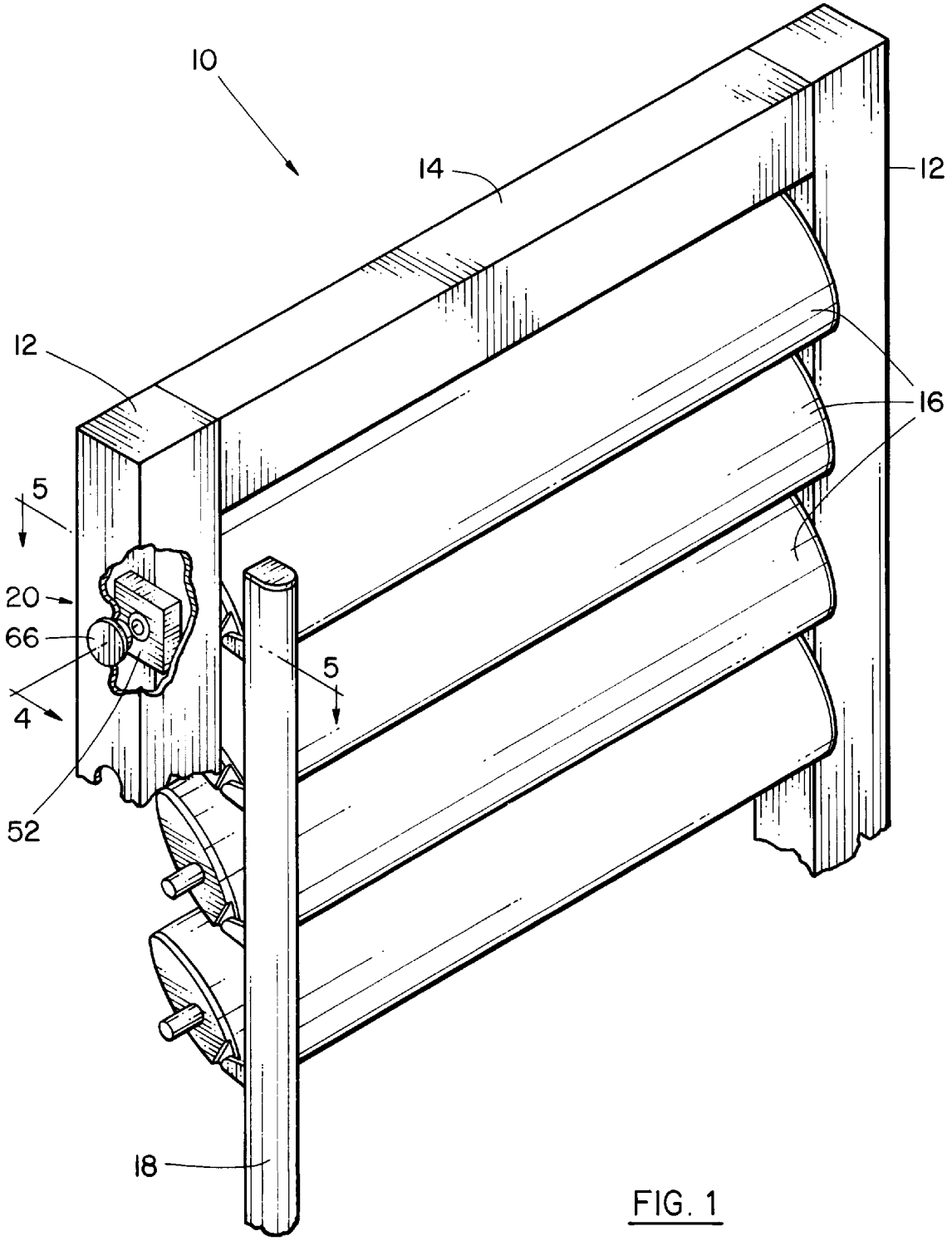
FIG. 1 is a perspective illustration of a portion of a shutter, showing the shutter frame construction, and four of the shutter blades extending across the shutter frame, and the end pull bar shown in position, and also showing the location of the frictional braking means.

Referring first of all to FIG. 1 a typical shutter is illustrated, partially cut away, by the general reference arrow 10.

The shutter typically comprises of parallel spaced apart side frames 12—12, and upper and lower cross members 14 (only the upper cross member being shown). The frames 12 and 14 are of hollow extruded thermo-plastic construction, and are typically provided with end caps (not referenced) which are known in the art per se.

The shaping and proportioning of the shutter frames 12 & 14 may vary from one shutter to another, and is no part of the present invention.

In order to provide a pleasing, aesthetic-looking closure for the shutter, a plurality of louvers or shutter slats are provided, indicated generally as 16. The shutter slats 16 are typically of generally aero-dynamic shape, along the length, when viewed in transverse section. The blades or slats 16 are rotatively mounted, in suitable rotatable bearings in side frames 12—12. They may typically may be spaced apart along the side frames by a distance which is proportional to the height of the shutter defined by the upper and lower cross members 14. Such spacing along the side frames may vary depending upon the proportioning of the shutters, and will be defined by the location of the bearings in the side frames 12—12. The blades or slats 16 in this embodiment, are simply pivotally mounted in the side frames 12—12. In order to move all of the slats 16 in unison, into uniform angular positions, a pull bar 18 is provided. The pull bar 18 in this embodiment is connected to the blades 16 along one end of all of the blade. This has the advantage that even when the blades are swung into a horizontal fully-open orientation, the shutter pull bar 18 is located away to one side, and therefore does not obstruct to any substantial extent. The openings defined between the individual blades or slats 16.

Still referring to FIG. 1, within one of the side frames 12, there is located a frictional braking means indicated generally as 20, the details of which will be described below.

Figure 2:
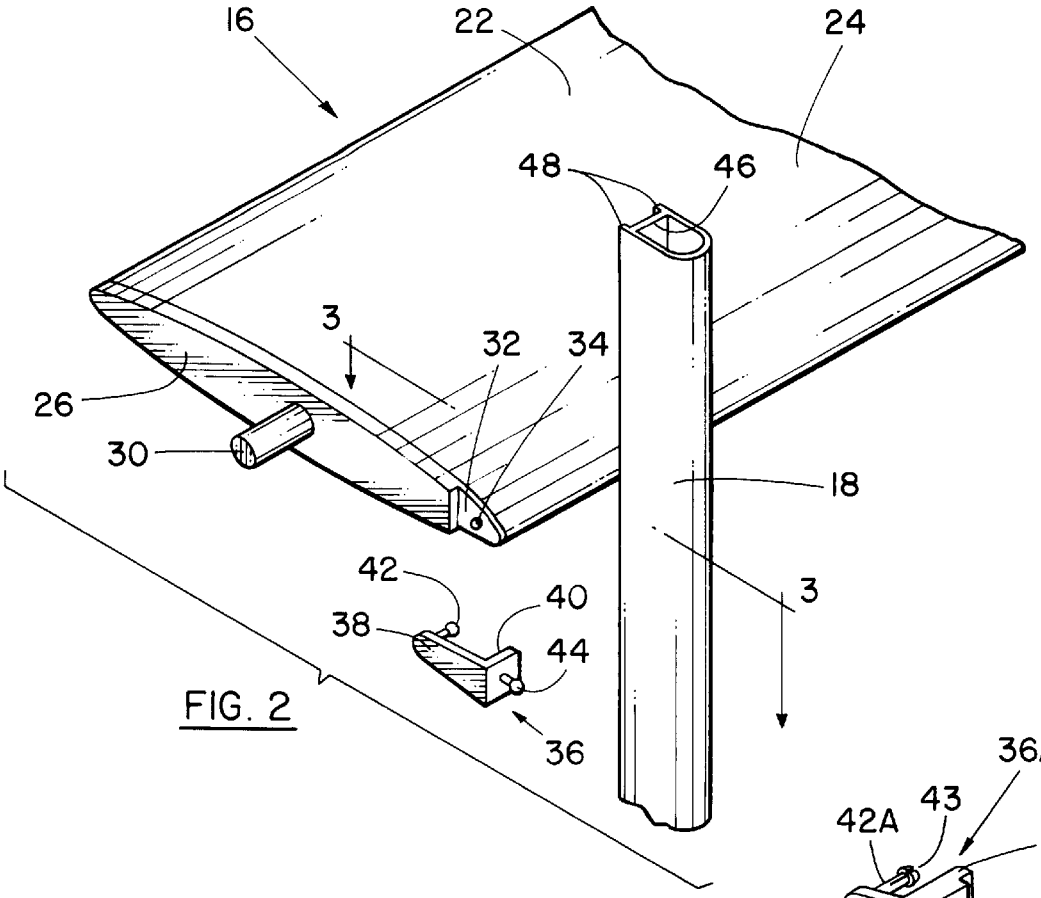
FIG. 2 is a perspective illustration, partially exploded, showing the end of one shutter blade, and a portion of the pull bar adjacent its rotatable coupling.
Figure 3:
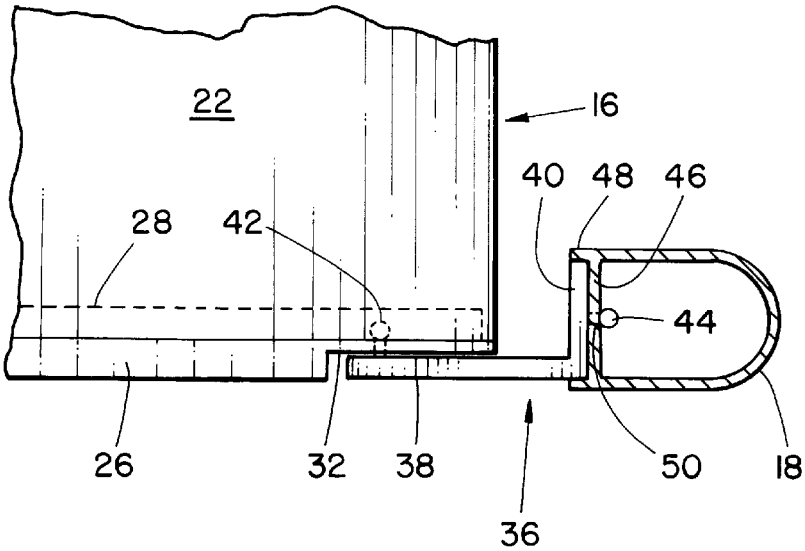
FIG. 3 is a sectional along the line 3—3 of FIG. 2, showing in this case the rotatable coupling snapped into the pull bar.

Turning now to FIGS. 2 and 3, the blades or slats 16 are illustrated there, partly cut away. The blades or slats 16 are of hollow flattened thermo-plastic extruded construction, and define upper and under walls 22, 24, which define a generally flattened elliptical shape in transverse section, giving them a pleasing, aesthetic appearance.

Within each end of the upper and under walls 22, 24, there are provided end closure members indicated as 26. The end closure members 26 have attachment portions 28 (in phantom), FIG. 3.

Each of the end members, in this embodiment, is formed with an integral stub axle 30. The axles 30 at each end extend into suitable openings (FIG. 4) formed in the side frames 12—12, to provide a pivotal mounting bearing for the slats or blades 16.

Adjacent one end of the end members 26, at one end of each of the blades or slats 16, there is formed a recessed portion 32, and that recessed portion 32 is provided with a pivot receiving hole or recess 34 (FIG. 2).

In order to connect each of the blades or slats 16 to the pull bar 18, a connecting link member indicated generally as 36 is provided. The connecting link member 36 is of generally L-shaped construction when viewed in plan, and comprises an elongated tab portion 38, and a generally right angular flange 40. The tab portion 38 is elongated and formed with a generally curved free end, and is adapted to nest in the recess 32 in the end closure 26. The tab portion 38 is formed with pivot means in this case a stud 42, having an enlarged end, which is adapted to be snap fitted into the hole 34 into the recess 32 of the end closure 26 and provide a pivotal connection The flange portion 40 is provided with a snap in attachment lock member 44, having an enlarged button on its free end.

Figure 2A:
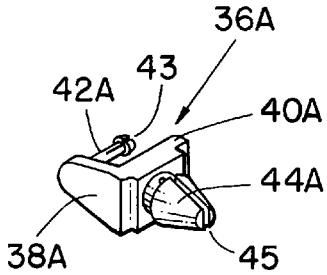
FIG. 2A is a perspective illustration of a modified form of rotatable coupling.

As illustrated in FIG. 2A the connecting member 36A may be provided in which a side tab 38A is formed integrally with a right angular flange 40A. The tab portion 38A is formed with an integral stud 42A having a median slot 43.

Flange 40A is formed with an integral stud 44A, having a median slot 45.

The formation of the studs 42A and 44A with slots facilitates the insertion of the studs into their respective recesses.

Pull bar 18 (FIGS. 2 & 3) is generally hollow extruded thermo-plastic construction, and is formed with a web wall 46, recessed into the interior of the pull bar 18. Side ribs 48 are formed along either side of the web 46, thereby defining a generally elongated shallow rectangular channel formation within the pull bar 18.

The flange 40 of the connecting member 36 is of generally rectangular shape and is adapted to be received snugly within the side ribs 48 of the pull bar 18. The locking member 44 is adapted to snap fit and attach into a suitable recess 50, formed in the web 46. There will be a plurality of such recesses 50, corresponding to the spacing between the slats or blades 16 along the side frames 12—12.

As will be seen from FIGS. 2, 3, 4 & 5, the pull bar 18 thus connects all of the slats 16 so that they all swing in unison and all adopt the same angular positions relative to the frames. The connecting links 36 provide a pivotal connection through the pivot pins 42 and the holes 34 to the blades 16. The locking members 44 provide a secure firm attachment to within the channels side walls 48 of the pull bar 18.

Thus operation of the pull bar 18 by hand will cause all of the blades 16 to rotate about their respective axles 30, in unison.

In order to provide a frictional braking means, to hold the blades in a pre-set position, the frictional brake illustrated generally as 20 in FIG. 1, may be included.

Figure 4:
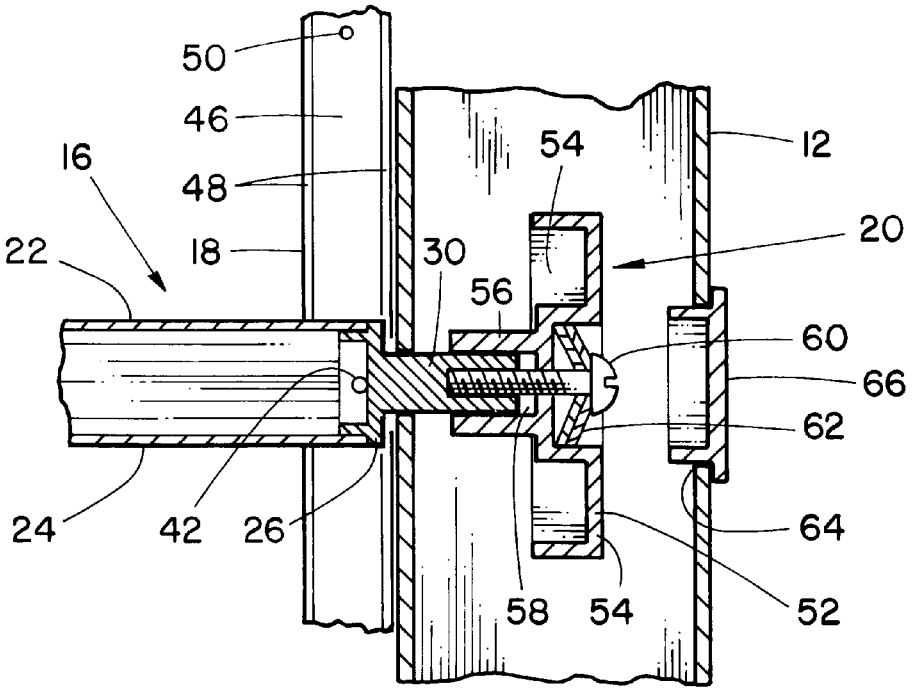
FIG. 4 is a sectional along the line 4—4 of FIG. 1, showing the construction of the frictional braking means.
Figure 5:
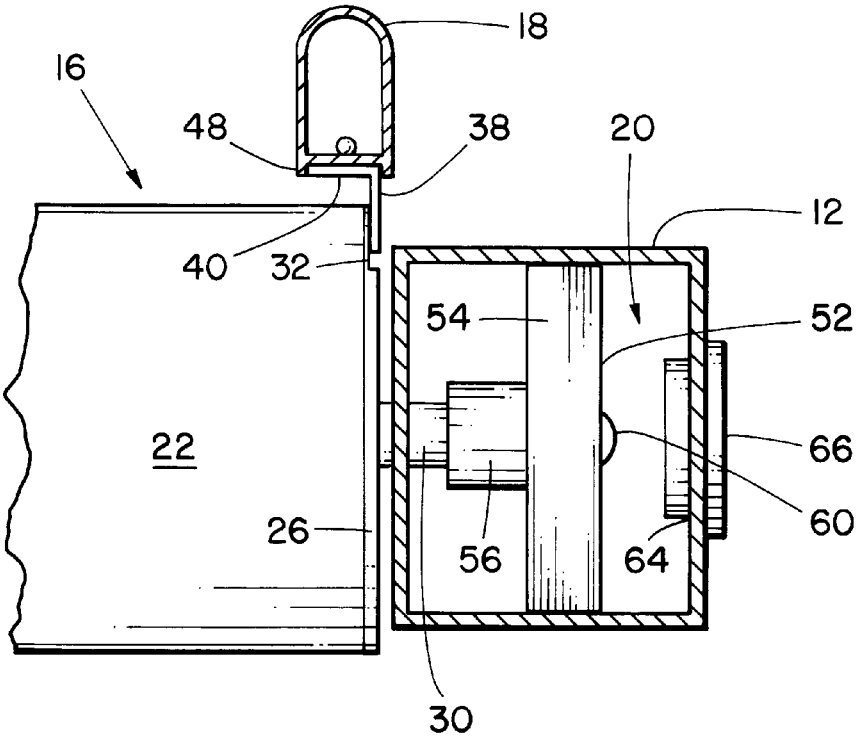
FIG. 5 is a sectional along the line 5—5 of FIG. 1, showing another position of the frame and the braking means.

The frictional braking means 20 is best illustrated in FIGS. 4 & 5. It will be seen to comprise a generally rectangular body 52, having side walls and top and bottom walls indicated generally as 54. The rectangular shape of the body 52 is designed to slide snugly within the hollow interior of the side frames 12 (FIG. 1).

In this way, the rectangular body is held and cannot rotate relative to the side frame.

Extending from the body 52 is a sleeve 56, defining a slightly cone-shaped interior recess 58. The interior cone-shaped recess 58 is designed to receive the free end of the axle 30 of one of the end members 26 of one of the blades 16. A fastening screw 60 passes through the centre of body 52 into axle 30. A spring washer 62 is located around screw 60 and applies a pre-determined adjustable axial pressure to the screw 60.

Thus, the operation of the washer 62 is such as to cause an axial tension to the axle 30, drawing it into the conical recess 58. By tightening up the screw 60 this axial tension can be increased.

The rotation of the axle 30 is thus subject to the binding frictional effect between the axle 30 and the conical recess 58 in the sleeve 56.

In order to give access to the screw 60, an opening 64 is formed in the side frame 12 in registration with the screw 60, and a closure plug 66 is provided for the opening 64.

It will thus been seen that means are provided for achieving a simple, adjustable, frictional binding effect on the rotation of the one axle 30 of the one blade 16. However, due to the fact that all of the blades 16 are interconnected by the pull bar 18, the one frictional locking means has the effect of providing a frictional binding on all of the blades 16, thereby holding all of them in a predetermined, preset position.

As already explained, the invention permits the manufacture of shutters in which the spacing between the blades can be varied during manufacture, between one shutter and another, so as to provide shutters of various height, dimensions, which have a uniform appearance.

Figure 6:
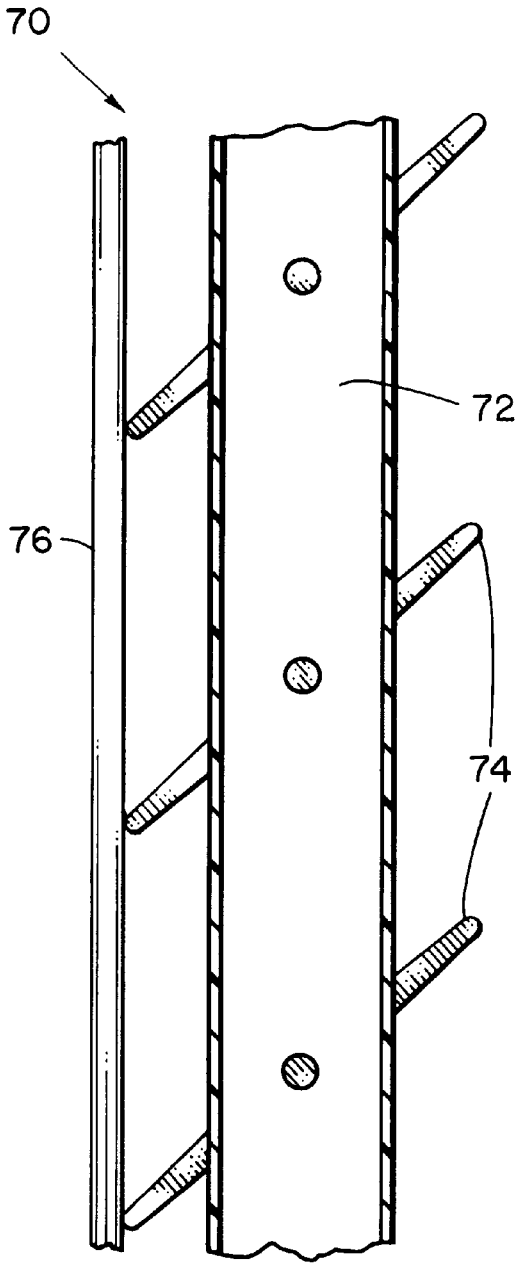
FIG. 6 is an elevational view of a blind, showing blind slats at a first predetermined spacing; and, FIG. 7 is an elevational view showing a blind with blind slats at a second pre-determined spacing.

Thus in FIG. 6, there is shown a shutter indicated generally as 70, having a pair of side frames 72—72, and top and bottom frame members (not shown), and blades 74 and a side pull bar 76.

The blades 76 have a first predetermined spacing between the axial pivot points, within the side frames 72—72.

Figure 7:
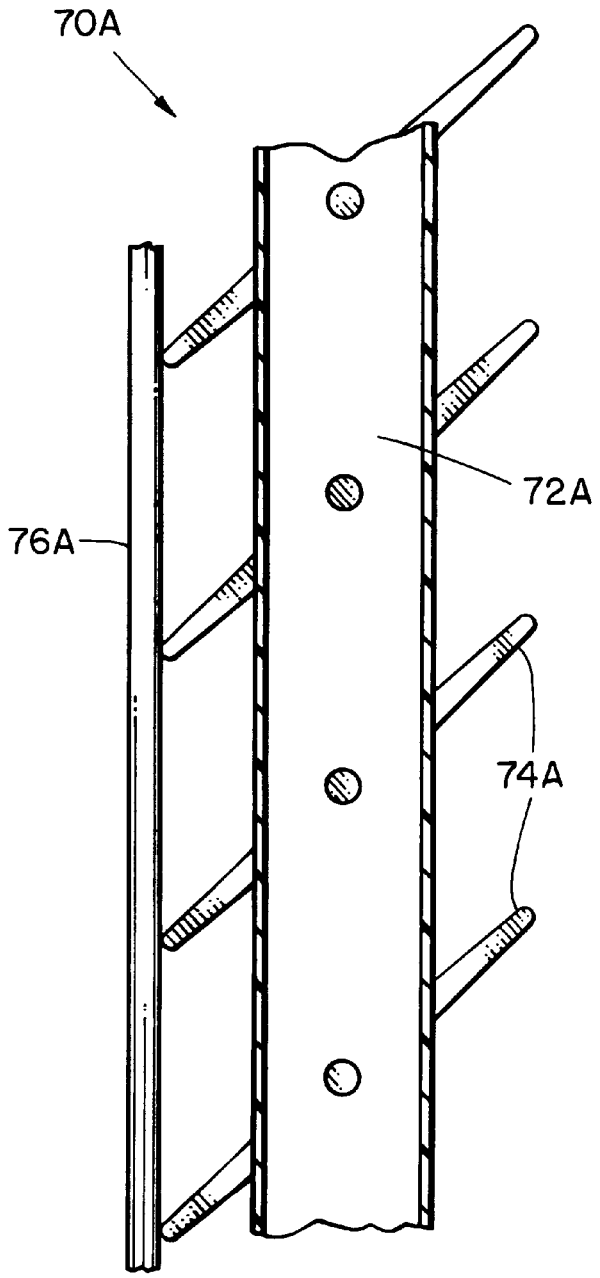

FIG. 7 illustrates another form of shutter 70A having side frames 72A and top and bottom frames (not shown) and shutter blades 74A and a side pull bar 76A.

In this shutter it will be seen that in the FIG. 7 embodiment the blades 74A are much closer together, than the blades 74 in FIG. 6. This is achieved by forming the pivot axes defined by holes drilled in the side frame 72A, which are much closer together than in the case of FIG. 6 shutter. The feature is also shown in the pull bar. In this case the connection holes formed in the pull bar, for receiving the lock members on the connectors, are formed at the same predetermined spacing as the spacing of the pivot holes in the side frames..

It will thus be seen that it is possible to produce two shutters having blade spacings which vary from one shutter to the other, and in which the pull bar has attachment holes which vary from one shutter to another, thereby enabling a uniform appearance in the top and bottom frames without the necessity for cutting them and breaking up the aesthetic appearance of the shutters.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A shutter having a generally rectangular frame and comprising;

side frame members and top and bottom members, of hollow thermo-plastic construction;

a plurality of hollow thermo-plastic blades extending horizontally from one side frame to the other;

end members on said blades with axles extending outwardly at each end and being received in holes in the side frames, the holes being located at predetermined spacings along the shutter frames, so as to provide a pleasing appearance and to permit complete closure of the shutter when the blades are rotated closed;

a pull bar connected to the shutter blades along one end of each of the blades;

connection link members defining two ends, there being a said connection link member for each respective blade;

pivot means at one end of each said link member pivotally connected with the end members of one end of each respective one of the blades;

pivot receiving recesses formed in end members at one end of each of the shutter blades and openings are formed in such recesses, to receive rotatable pivot means of said connection link members therein and, attachment means at the other said end of each said connection link member operatively coupled to the pull bar, whereby operation of the pull bar upwardly or downwardly will move all of the shutter blades simultaneously by rotating the same between closed and opened positions.

2. A shutter as claimed in claim 1 and wherein said connection link members are pivotally connected to the end members of the shutter blades and are attached at spaced points along the pull bar, so that the pull bar extends between the connection link members, thereby coupling all the blades for movement together in unison.

3. A shutter as claimed in claim 2 and wherein the side frames have holes on predetermined spacings, and wherein the pull bar has fastening openings on the same predetermined spacings as the holes in the side frames.

4. A shutter as claimed in claim 3 and wherein a first shutter is made as aforesaid and wherein a second shutter has pivot holes in the side frames on spacings which are different from said first shutter, and wherein said second shutter has fastening openings in the pull bar which are at corresponding spacings.

5. A shutter as claimed in claim 1 and wherein the pull bar is formed of hollow extruded construction of thermo-plastic material, and wherein connection link members are each formed with a lock member for snapping into a corresponding opening in the pull bar, so that each of the connection link members is attached to the pull bar at a predetermined spaced apart location corresponding to the spacing between the blade receiving openings in the side frames.

6. A shutter as claimed in claim 5 wherein said lock members are formed as studs, and including median slots formed in said studs.

7. A shutter as claimed in claim 1 and wherein the rotatable pivot couplings are connected to the end members of each of the shutter blades, and these rotatable couplings are integrally formed with respective pull bar connection link members, attached to the pull bar at spaced intervals.

8. A shutter as claimed in claim 7 wherein said pivot couplings are formed as pins and wherein median slots are formed in said pins.

9. A shutter as claimed in claim 1 and wherein braking friction means is connected to one of the shutter blade axles, and being located within a side frame, and providing a frictional binding on the shutter blade to which it is connected, and to the pull bar, the braking means thereby controlling the angular positions of all of the shutter blades in that shutter.

10. A shutter having a generally rectangular frame and comprising:

side frame members and top and bottom members, of hollow thermo-plastic construction;

a plurality of hollow thermo-plastic blades extending horizontally from one side frame to the other;

end members on said blades with pivot axles extending outwardly at each end and being received in pivot holes in the side frames, the pivot holes being located at predetermined spacings along the shutter frames, so as to provide a pleasing appearance and to permit complete closure of the shutter when the blades are rotated closed;

a pull bar connected to the shutter blades along one end of each of the blades;

connection members pivotally connected with the end members of one end of each of the blades, and being operatively coupled to the pull bar, whereby operation of the pull bar upwardly or downwardly will move all of the shutter blades simultaneously by rotating the same between closed and opened positions, and, pivot receiving recesses on one of each of said end members at one end of each blade, and openings are formed in such recesses, to receive rotatable pivot couplings of said connection members therein.

11. A shutter having a generally rectangular frame and comprising:

side frame members and top and bottom members, of hollow thermo-plastic construction;

a plurality of hollow thermo-plastic blades extending horizontally from one side frame to the other;

end members on said blades with pivot axles extending outwardly at each end and being received in pivot holes in the side frames, the pivot holes being located at predetermined spacings along the shutter frames, so as to provide a pleasing appearance and to permit complete closure of the shutter when the blades are rotated closed;

a pull bar connected to the shutter blades along one end of each of the blades;

connection members pivotally connected with the end members of one end of each of the blades, and being operatively coupled to the pull bar, whereby operation of the pull bar upwardly or downwardly will move all of the shutter blades simultaneously by rotating the same between closed and opened positions, and, braking friction means connected to one of the shutter blade pivots, and being located within a side frame, and providing a frictional binding on the shutter blade to which it is connected, and to the pull bar, the braking means thereby controlling the angular positions of all of the shutter blades in that shutter.

12. A shutter having a generally rectangular frame and comprising;

side frame members and top and bottom members, of hollow thermo-plastic construction;

a plurality of hollow thermo-plastic blades extending horizontally from one side frame to the other;

end members on said blades with axles extending outwardly at each end and being received in holes in the side frames, the holes being located at predetermined spacings along the shutter frames, so as to provide a pleasing appearance and to permit complete closure of the shutter when the blades are rotated closed;

a pull bar connected to the shutter blades along one end of each of the blades;

connection link members defining two ends, there being a said connection link member for each respective blade;

pivot means at one end of each said link member pivotally connected with the end members of one end of each respective one of the blades;

attachment means at the other said end of each said connection link member operatively coupled to the pull bar, whereby operation of the pull bar upwardly or downwardly will move all of the shutter blades simultaneously by rotating the same between closed and opened positions; and, braking friction means connected to one of the shutter blade axles, and being located within a side frame, and providing a frictional binding on the shutter blade to which it is connected, and to the pull bar, the braking means thereby controlling the angular positions of all of the shutter blades in that shutter.

* * * * *